US005320337A

United States Patent [19]

Itoh et al.

[11] Patent Number: 5,320,337

[45] Date of Patent: Jun. 14, 1994

[54] PAPER SEPARATING MEMBER FOR PAPER FEEDING DEVICE

[75] Inventors: Yasuchika Itoh, Nishinomiya; Masahiro Tanigawa, Akashi; Hitoshi Itani; Soichiro Kozuka, both of Kobe, all of Japan

[73] Assignee: Sumitomo Rubber Industries, Ltd., Kobe, Japan

[21] Appl. No.: 968,148

[22] Filed: Oct. 29, 1992

[30] Foreign Application Priority Data

Dec. 17, 1991 [JP] Japan ..... 3-333030

[51] Int. Cl.[5] ..... B65H 3/52

[52] U.S. Cl. ..... 271/124; 271/121

[58] Field of Search ..... 271/121, 124, 125

[56] References Cited

U.S. PATENT DOCUMENTS 5,022,642 6/1991 Hasegawa et al. ..... 271/121
5,163,668 11/1992 Winship et al. ..... 271/124

FOREIGN PATENT DOCUMENTS 458619 11/1991 European Pat. Off. ..... 271/121
180638 7/1988 Japan ..... 271/124
3147650 6/1991 Japan ..... 271/121
3200646 9/1991 Japan ..... 271/121
3284561 12/1991 Japan ..... 271/121

*Primary Examiner*—H. Grant Skaggs
*Attorney, Agent, or Firm*—Nikaido, Marmelstein, Murray & Oram

[57] ABSTRACT

It is intended to suppress the production of "creak" during paper feed. A support block having a friction rubber element mounted thereon to be rubbed by paper sheets is made of a resin compound having a specific gravity of 2.0 or more containing metal powder.

4 Claims, 1 Drawing Sheet

PAPER SEPARATING MEMBER FOR PAPER FEEDING DEVICE

BACKGROUND OF THE INVENTION

The present invention relates to a paper separating member used in the paper feeding device of a copying machine or printer, for preventing the concurrent feed of two paper sheets.

There are a variety of paper feeding devices for copying machines, printers and the like, and a paper feeding device 1 shown in FIG. 3 can be designed most compact and its construction is simple, so that it is widely used in copying machines, printers and the like.

The paper feeding device 1 comprises a paper feed roller 2 of rubber journaled for rotation, and a paper separating member 3 opposed to said paper feed roller 2 in substantial contact with the latter. A number of paper sheets 4*a*, 4*b*, etc. stored in a cassette (not shown) are delivered one by one by the rotation of the feed roller 2. In order to feed only one sheet 4*a* while preventing the concurrent feed of two paper sheets 4*a*, 4*b*, etc. the paper separating member 3 is pressed against the undesirable paper sheet 4*b* entering below the paper sheet 4*a* to be delivered, thereby separating the paper sheet 4*b* from the paper sheet 4*a* to be delivered and stopping it by the frictional resistance between the paper sheet 4*b* and the paper separating member 3.

The paper separating member 3 comprises a support block 3*a* and a planar friction rubber element 3*b* mounted thereon to be slide-contacted by the paper sheets 4*a*, 4*b*, etc. Heretofore, ABS resin and the like have been widely used to form said support block 3*a*.

In said paper feeding device 1, an abnormal sound called "creak" is sometimes produced during paper feed, said sound being produced more readily particularly when the paper sheets 4*a*, 4*b*, etc. to be fed are coated paper or OHP films. The above-mentioned "creak" originates in the fact that the rubbing between the friction rubber element 3*b* of the paper separating member 3 and the paper sheets 4*a*, 4*b*, etc. produces vibrations with which the attaching members and the like for the paper separating member 3 resonate, producing unpleasant creaking sounds. Therefore, if ABS resin of low specific gravity (standard product: Specific gravity 1.05) is used as the support block 3*a* for the paper separating member as in the prior art, the vibrations are easily transferred to the attaching members and the like for the paper separating member during paper feed, producing "creak".

Accordingly, to suppress vibrations, a weight of aluminum or lead has been stuck to the paper separating member 3, but this is unsightly and decreases productivity, leading to cost increase.

SUMMARY OF THE INVENTION

The present invention has been made with the above in mind, and is intended to provide a paper separating member for a paper feeding device adapted to suppress the production of abnormal sounds during paper feed.

To achieve said object, the present invention is characterized in that a support block for a paper separating member is made of a resin compound having a specific weight of 2.0 or more comprising a resin polymer containing inorganic powder such as metal powder.

In a paper separating member according to the present invention, a support block is made of a resin compound having a specific weight of 2.0 or more comprising a resin polymer containing inorganic powder such as metal powder, with the result that the vibrations which are produced when the friction rubber element is rubbed by a paper sheet hardly transfer to the attaching members and the like for the paper separating member, thus preventing the attaching members and the like from resonating with the vibrations and hence the production of "creak" can be suppressed.

DESCRIPTION OF THE PREFERRED EMBODIMENTS

Figure 1:
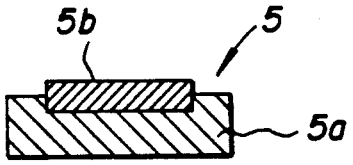
FIG. 1 is a longitudinal sectional view showing an embodiment of a paper separating member for a paper feeding device according to the present invention.
Figure 2:
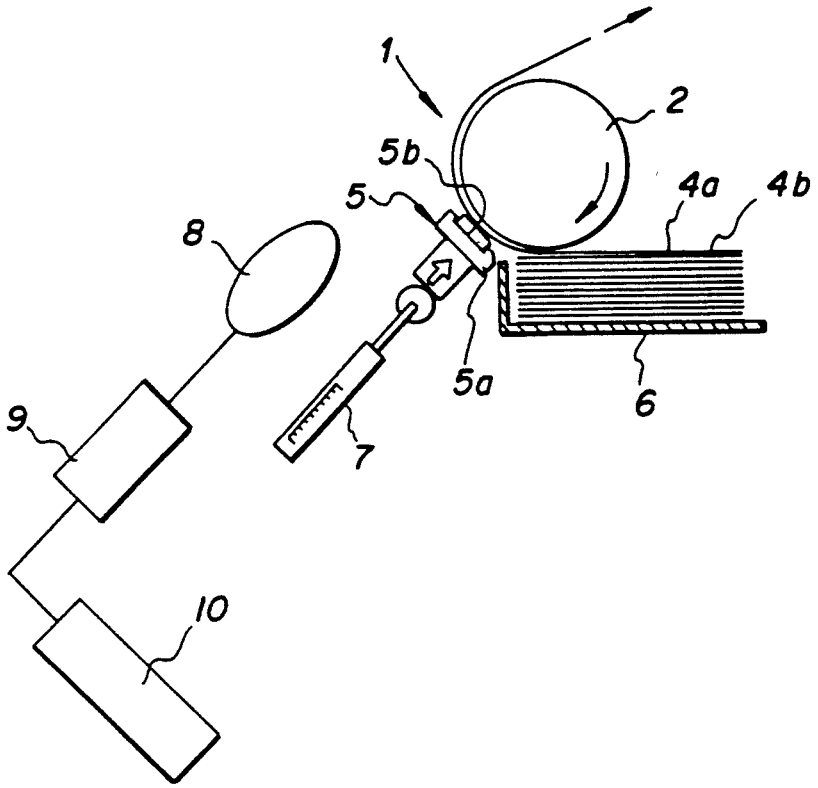
FIG. 2 a structural view of en experimental device for measuring the creak of paper separating members.
Figure 3:
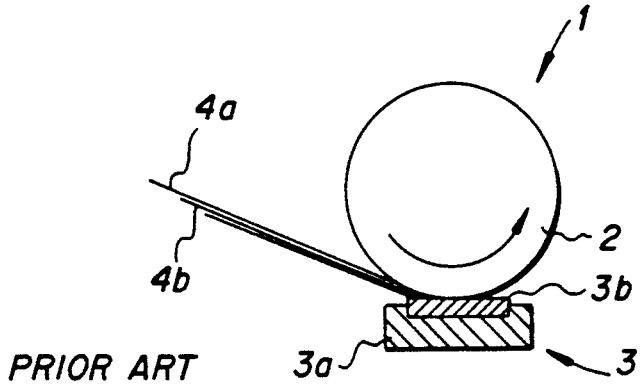
FIG. 3 PRIOR ART
FIG. 3 a structural view showing an example of a paper feeding device.

An embodiment of a paper separating member for a paper feeding device according to the present invention will now be described with reference to FIGS. 1 and 2. In FIGS. 1 and 2, the same components as those shown in FIG. 3 are denoted by the same reference characters and a description thereof is omitted.

A paper separating member 5*a* according to the present invention, as shown in FIG. 1, comprises a support block 5 made of a resin compound having a specific weight of 2.0 or more comprising a resin polymer containing inorganic powder such as magnesium oxide, zinc powder or lead silicate powder, and a planar friction rubber element 5*b* mounted on said support block to be rubbed by paper sheets 4*a*, 4*b*, etc. under pressure.

Since the paper separating member 5 of the present invention has its support block 5*a* made of a resin compound of high specific gravity, the vibrations produced when the friction rubber element 5*b* and paper sheets 4*a*, 4*b*, etc. rub each other, hardly transmit to the attaching members and the like for the paper separating member 5, so that the attaching members and the like do not respond with the vibrations and hence the production of "creak" can be suppressed.

The table 1 below shows the results of measurements conducted to prove that the production of "creak" can be suppressed by the paper separating member of the present invention. As shown in FIG. 2, a paper feeding roller 2 and a paper separating member 5 are disposed at the paper delivery section of a cassette 6 containing a number of paper sheets 4*a*, 4*b*, etc. to hold the paper sheets under pressure. The paper sheets 4*a*, 4*b*, etc. are delivered by the feed roller 2 while the paper separating member 5 is loaded by a push-pull gage 7, and the sound pressure level is measured by a noise meter 9 and an FFT analyzer 10 through a microphone 8. The conditions for measurements are: The peripheral roller speed; 28 mm/sec, load; 400 g, measurement frequency; 0–2000 Hz, room temperature; 23.5° C., measured paper; PPC paper.

TABLE 1

| | Experiment 1 | Experiment 2 | Experiment 3 | Experiment 4 | Experiment 5 |
|---|---|---|---|---|---|
| Sound pressure level | 77 dB | 75 dB | 75 dB | 74 dB | 74 dB |
| Specific | 1.05 | 2.15 | 2.7 | 3.55 | 3.7 |

TABLE 1-continued

| | Experiment 1 | Experiment 2 | Experiment 3 | Experiment 4 | Experiment 5 |
|---|---|---|---|---|---|
| gravity | | | | | |
| peripheral roller speed | 28 mm/sec | | | | |
| load | 400 g | | | | |
| measurement frequency | 0–2000 Hz | | | | |
| room temperature | 23.5° C. | | | | |
| humidity | 55% | | | | |

In the table 1, the experiment 1 refers to the case where the support block is made of ABS resin (standard product, specific gravity 1.05); the experiment 2 refers to the case where the support block is made of a resin compound (H1651: made by DAICEL HÜLS LTD., specific gravity 2.15) containing magnesium oxide powder; the experiment 3 refers to the case where the support block is made of a resin compound (HG1200: made by CALP CORPORATION, specific gravity 2.7) containing zinc powder; the experiment 4 refers to the case where the support block is made of a resin compound (HG2700: made by CALP CORPORATION, specific gravity 3.55) containing zinc powder; and the experiment 5 refers to the case where the support block is made of a resin compound (KC1963: made by DAICEL HÜLS LTD., specific gravity 3.7) containing lead silicate powder. In addition, the experiments 3 and 4, used different resin polymer compounds each containing zinc powder.

As is clear from the above experimental results, in the measurement frequency of 0–2000 Hz, the sound pressure level is lower by 2, 2, 3 and 3 dB in the experiments 2, 3, 4 and 5, respectively, than in the experiment 1. From this fact it is clear that if the support block for the paper separating member is made of a resin compound whose specific gravity is 2.0 or more, this is effective to suppress the production of "creak".

As has been described so far, the paper separating member for a paper feeding device according to the present invention is designed to make it difficult for the vibrations produced when it is rubbed by a paper sheet to transfer to the attaching members and the like for the paper separating member; therefore, said attaching members and the like do not respond and hence the production of "creak" can be suppressed. Further, the since the paper separating member of the present invention can be made by injection molding, its external appearance is improved as compared with the conventional technique sticking a weight of aluminum or lead and mass production can be employed, preventing an increase in cost.

What is claimed is:

1. In a paper feeding apparatus, adapted to be used to selectively permit the feeding of only one sheet of paper at a time, which comprises:

a source of multiple sheets of paper;

rotary means to strip paper from said source;

a paper separating member comprising:

a friction element, in contact with said paper, operatively associated with said rotary means to limit the number of sheets of paper stripped from said source to one; and support block means operatively supporting with said friction element; and loading means urging said support block means and, through said support block means, said friction element into paper separating association with said paper and said rotary means, whereby creating noise, by the vibration resulting from the moving contact between said paper and said friction element, and broadcasting said noise;

the improvement, whereby suppressing said broadcasting of vibrational noise which comprises:

said support block means comprising a resin polymer matrix containing a filler of high enough specific gravity such that said support block means has a specific gravity of at least about 2 which is sufficient to substantially suppress the broadcasting of said vibrational noise.

2. An improved paper separating member as claimed in claim 1 wherein said support block means is in direct supporting contact with said frictional element and with said loading means.

3. An improved paper separating member as claimed in claim 1 wherein said support block means comprises a matrix containing an inorganic filler having a high specific gravity.

4. An improved paper separating member as claimed in claim 1 wherein said support block means comprises a polymer resin filled with inorganic powder comprising a metal.

* * * * *